US007188922B2

(12) United States Patent
Kubo

(10) Patent No.: US 7,188,922 B2
(45) Date of Patent: Mar. 13, 2007

(54) RECORDING APPARATUS EQUIPPED WITH HEATSINK

(75) Inventor: Tomoyuki Kubo, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 260 days.

(21) Appl. No.: 10/798,132

(22) Filed: Mar. 11, 2004

(65) Prior Publication Data

US 2004/0189730 A1 Sep. 30, 2004

(30) Foreign Application Priority Data

Mar. 26, 2003 (JP) ..... 2003-085663

(51) Int. Cl.
*B41J 29/377* (2006.01)

(52) U.S. Cl. ..... 347/18

(58) Field of Classification Search ..... 347/18
See application file for complete search history.

(56) References Cited

U.S. PATENT DOCUMENTS 4,714,936 A * 12/1987 Helinski et al. ..... 347/38
4,821,051 A * 4/1989 Hediger ..... 347/130
5,017,941 A * 5/1991 Drake ..... 347/67
5,079,567 A * 1/1992 Beaman et al. ..... 346/139 R
5,258,781 A * 11/1993 John ..... 347/63
6,007,176 A * 12/1999 Askren et al. ..... 347/18
6,065,823 A * 5/2000 Kawamura ..... 347/18
6,339,444 B1 * 1/2002 Sugiyama ..... 347/200
6,343,848 B2 * 2/2002 Berg et al. ..... 347/18
6,604,817 B2 * 8/2003 Isono et al. ..... 347/71
6,614,460 B2 * 9/2003 Susukida et al. ..... 347/202
6,623,094 B2 * 9/2003 Murakami ..... 347/18
6,655,785 B1 * 12/2003 Hilton et al. ..... 347/49
6,908,170 B2 * 6/2005 Merz ..... 347/18
6,945,638 B2 * 9/2005 Teung et al. ..... 347/74
6,975,466 B2 * 12/2005 Umeyama et al. ..... 359/896
2002/0105567 A1 8/2002 Yamada
2003/0150931 A1 * 8/2003 Drury et al. ..... 239/102.1
2004/0021721 A1 * 2/2004 Baxter ..... 347/18

FOREIGN PATENT DOCUMENTS

JP 09076485 A * 3/1997
JP 09240110 A * 9/1997

* cited by examiner

*Primary Examiner*—Stephen Meier
*Assistant Examiner*—Rene Garcia, Jr.
(74) *Attorney, Agent, or Firm*—Reed Smith LLP.

(57) ABSTRACT

A recording apparatus having: (a) a head unit including an actuator which generates energy required for recording predetermined patterns of image on a recording medium; (b) a circuit board including a driver element which drives the actuator of the head unit; and (c) a heatsink disposed in thermally conductive communication with the driver element. The heatsink has a void portion which is opposed to the head unit.

20 Claims, 7 Drawing Sheets

RECORDING APPARATUS EQUIPPED WITH HEATSINK

This application is based on Japanese Patent Application No. 2003-085663 filed in Mar. 26, 2003, the content of which is incorporated hereinto by reference.

BACKGROUND OF THE INVENTION

1. Field of the Invention

The present invention relates in general to a recording apparatus equipped with (a) a head unit including an actuator which generates energy required for recording predetermined patterns of image on a recording medium, (b) a circuit board including a driver element which drives the actuator, and (c) a heatsink disposed in thermally conductive communication with the driver element.

2. Discussion of Related Art

There is known a recording apparatus equipped with (a) a head unit including an actuator which generates energy required for recording predetermined patterns of image on a recording medium, (b) a circuit board including a driver element which drives the actuator, and (c) a heatsink disposed in thermally conductive communication with the driver element.

As an example of such a recording apparatus, JP-A-2002-240306 (the content of which is incorporated in U.S. patent application published as US 2002/0105567 A1) discloses an ink jet recording apparatus having head units. Each of the head units has a plurality of nozzles, a plurality of pressure chambers corresponding to the respective nozzles, and an actuator (piezoelectric actuator) for pressurizing an ink in each of the pressure chambers so as to deliver the ink from a corresponding one of the nozzles. The head units, together with a cover plate, is attached to a bottom face of a body frame. The head units,. except their respective portions in which the nozzles are open, are covered with the cover plate. The ink jet recording apparatus further has flexible circuit boards each of which has a driver element (driver circuit chip) mounted thereon and serving to drive the actuator. Each of the flexible circuit boards is connected with the actuator, and extends along the bottom and side faces of the body frame. Another cover plate. (lid plate) is attached to the body frame so as to cover the flexible wiring boards. The driver elements of the flexible circuit boards are pressed, by an elastic member (made of rubber or sponge) that is secured to the side face of the body frame, against the above-described another cover plate. Thus, the another cover plate serves as a heatsink for radiating or dissipating heat generated by activation of the driver elements which are held in contact with the another cover plate.

In recent years, as a result of provision of an increased number of nozzles with an increased density in the head unit, a wiring arrangement connecting the driver element and the actuator has become denser, and each wire of the wiring arrangement has become finer. Due to the denser wiring arrangement and the finer wire, signals fed through the wires tend to be easily affected by noises. It is therefore necessary to arrange the driver element and the actuator with a closer distance therebetween, so as to reduce length of each wire of the wiring arrangement. However, the increased number of nozzles leads to an increase in amount of heat generated by the driver element, and the increased amount of heat is easily transferred through the body frame or the heatsink, to the actuator which is positioned to be close to the driver element. With the actuator being heated by the heat, the actuator suffers from change in its actuation property (particularly, where piezoelectric elements are used in the actuator). With the ink being heated, physical property of the ink is changed. The changes in the actuation property of the actuator and the physical property of the ink cause deterioration in the quality of the printed image.

SUMMARY OF THE INVENTION

The present invention was made in view of the background prior art discussed above. It is therefore an object of the present invention to provide a recording apparatus capable of preventing deterioration in the quality of the printed image, which could be caused if the head unit of the apparatus were thermally affected. This object may be achieved according to any one of first through fifth aspects of the invention which are described below.

The first aspect of the invention provides a recording apparatus comprising: (a) a head unit including an actuator which generates energy required for recording predetermined patterns of image on a recording medium; (b) a circuit board including a driver element which drives the actuator of the head unit; and (c) a heatsink disposed in thermally conductive communication with the driver element, wherein the heatsink has a void portion which is opposed to the head unit.

In the present recording apparatus, the heatsink is disposed in thermally conductive communication with the driver element, so as to radiate or dissipate heat generated by activation of the driver element. When the driver element is activated at a high processing speed, an amount of the generated heat is increased whereby the heatsink is also heated to have a high temperature. However, owing to the void portion of the heatsink which portion is opposed to the heat unit, it is possible to minimize transfer of the heat from the heatsink to the head unit, even if the driver element is positioned to be close to the head unit. Thus, the head unit is prevented from being considerably heated or thermally affected, whereby deterioration in the quality of the printed image can be minimized.

According to the second aspect of the invention, in the recording apparatus defined in the first aspect of the invention, the head unit further includes a cavity unit which stores an ink in cavities formed therein, wherein the actuator is a piezoelectric actuator which is superposed on the cavity unit and which is operable to eject the ink onto the recording medium.

In the recording apparatus according to the second aspect of the invention in which the head unit includes the cavity unit and the piezoelectric actuator are superposed on each other, considerable changes in the actuation property of the piezoelectric elements and the physical property of the ink are prevented even if the heatsink is heated to have a high temperature. That is, it is possible to provide an ink-jet head capable of preventing deterioration in the quality of the printed image, which could be caused if the head unit were thermally affected by the heatsink.

According to the third aspect of the invention, in the recording apparatus defined in the first or second aspect of the invention, the void portion of the heatsink includes an aperture formed through the heatsink such that the aperture overlaps at least a portion of the head unit as viewed in a direction in which the void portion of the heatsink and the head unit are opposed to each other.

In the recording apparatus according to the third aspect of the invention, the aperture is formed through a portion of the heatsink which portion is the close to the head unit, so that the head unit is efficiently prevented from being considerably heated by the heat transferred from the heatsink. Further, in this recording apparatus in which the void portion of the heatsink takes the form of an aperture portion, a non-aperture portion of the heatsink can serve also as an integrally constructed member.

According to the fourth aspect of the invention, in the recording apparatus defined in any one of the first through third aspects of the invention, the void portion of the heatsink includes a plurality of holes formed through the heatsink.

In the recording apparatus according to the fourth aspect of the invention, the head unit is prevented from being considerably heated by the heat transferred from the heatsink, owing to the plurality of holes of the void portion of the heatsink which is opposed to the head unit. Since the void portion includes the plurality of through-holes, it is possible to design number, sizes and positions of the through-holes with a high degree of freedom. Thus, the void portion has a high degree of freedom of design in its arrangement.

According to the fifth aspect of the invention, in the recording apparatus defined in any one of the first through fourth aspects of the invention, the apparatus further comprises a heat dissipation member disposed in thermally conductive communication with the head unit and spaced apart from the heatsink, so as to dissipate heat from the head unit.

In the recording apparatus according to the fifth aspect of the invention, the heat dissipation member, which is independent from the heatsink having the void portion, is disposed in thermally conductive communication with the head unit. The heat dissipation member serves to remove the heat generated by the head unit per se, for thereby preventing the head unit from being considerably heated by the heat generated by itself. Further, since the heat dissipation member is disposed without its contact with the heatsink, it is possible to prevent transfer of the heat from the heatsink to the heat dissipation member.

BRIEF DESCRIPTION OF THE DRAWINGS

The above and other objects, features, advantages and technical and industrial significance of the present invention will be better understood by reading the following detailed description of presently preferred embodiment of the invention, when considered in connection with the accompanying drawings, in which.

DETAILED DESCRIPTION OF THE PREFERRED EMBODIMENT

Figure 1:
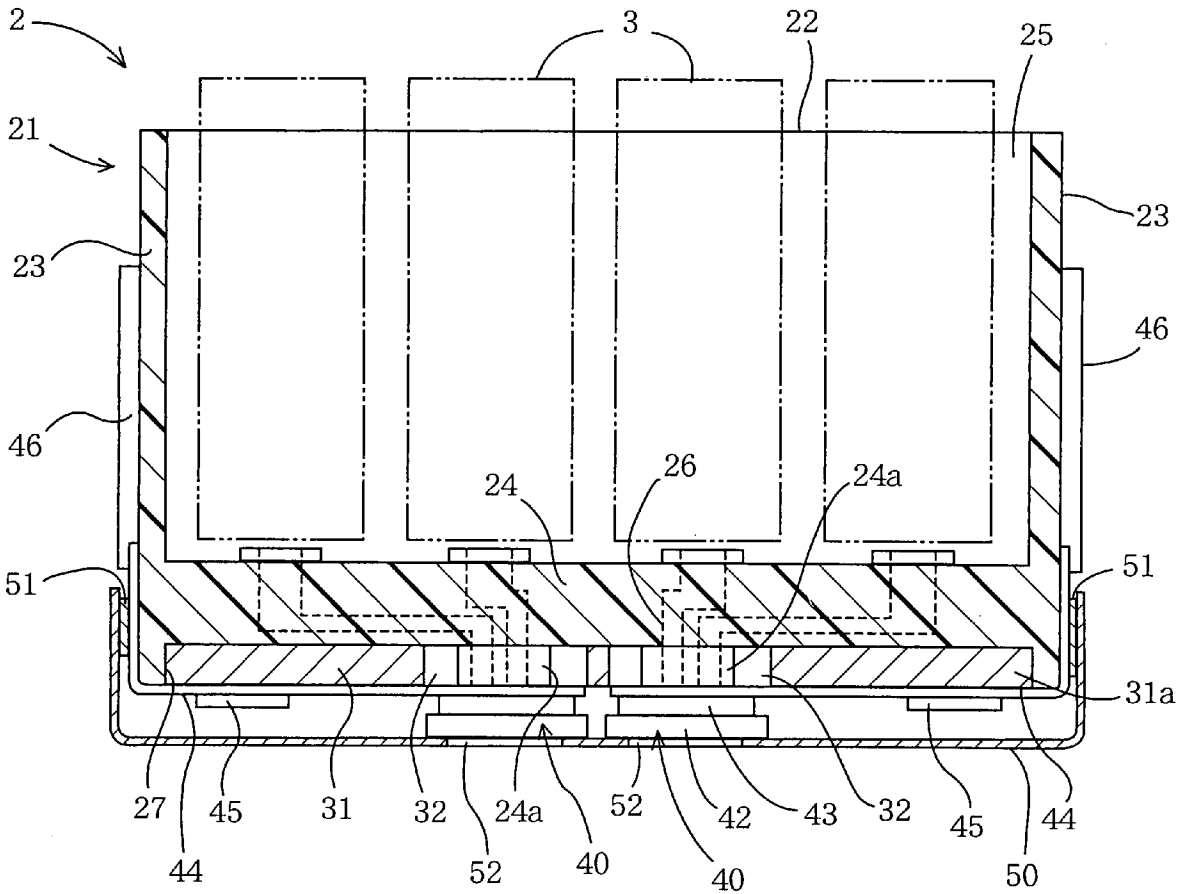
FIG. 1 is a front view in cross section of a recording head portion of a recording apparatus which is constructed according to an embodiment of the invention.

FIG. 1 shows a recording head portion 2 provided in a recording apparatus constructed according to an embodiment of the invention. As in a common recording apparatus, this recording head portion 2 is mounted on a carriage (not shown) which is arranged to be movable along a recording medium, so that ink droplets are ejected from head units provided in the recording head portion 2, for recording desired patterns of images on the recording medium.

The recording head portion 2 has a body frame 21 which is formed of a synthetic resin such as polyethylene and polypropylene by an injection molding machine. The body frame 21 is provided by a box-like structure, and has an upper open end. Described more specifically, the body frame 21 has a bottom plate 24, a pair of side plates 23 respectively extending upwardly from right and left ends of the bottom plate 24, and a back plate 22 extending upwardly from a rear end portion of the bottom plate 24. The body frame 21 has, in its inside, a mount portion 25 onto which a plurality of ink cartridges 3 (consisting of four ink cartridges in the present embodiment) as ink supply sources are removably mounted. In the mount portion 25 of the body frame 21, a plurality of ink supply passages 26 are formed through the bottom plate 24 such that the ink supply passages 26 are connectable with ink ejection portions of the respective ink cartridges 3.

Figure 3:
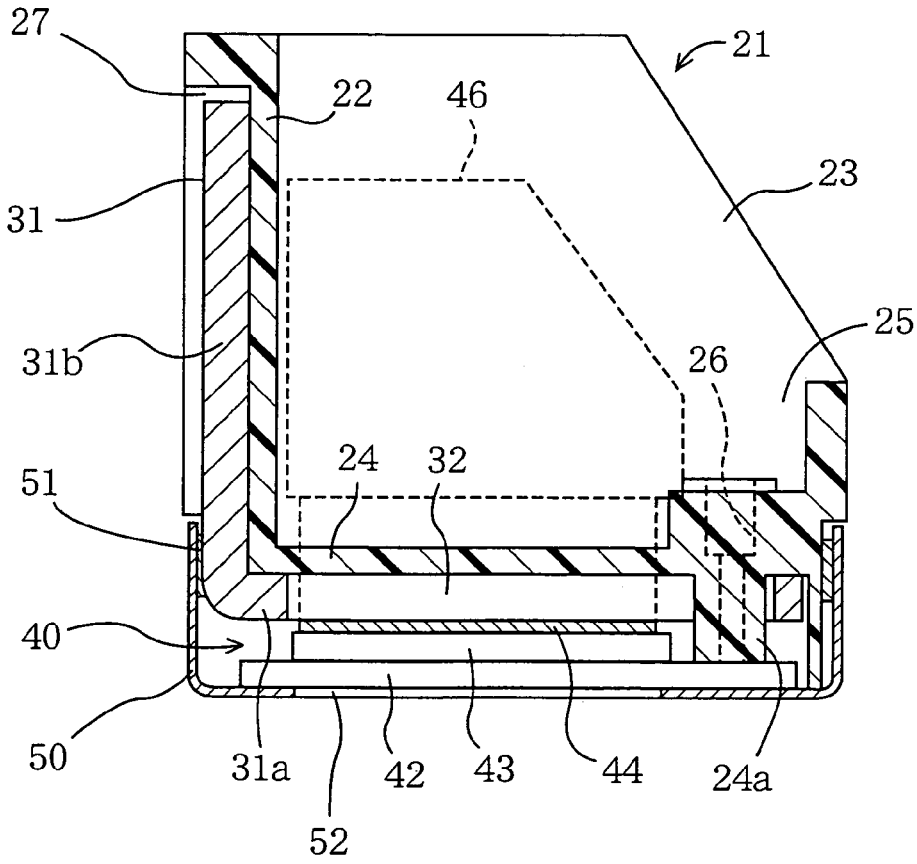
FIG. 3 is a side view in cross section of the recording head portion of FIG. 1.

The body frame 21 has a recess 27 which extends along a lower or outside surface of the bottom plate 24 and an outside surface of the back plate 22 so as to have a L shape as seen in FIG. 3, i.e., a side view in cross section of the recording head portion 2. A heatsink 31 is provided to be accommodated within the L-shaped recess 27. The heatsink 31 also has a L shape as seen in FIG. 3, and is bonded or otherwise fixed in the recess 27. In the present embodiment, the heatsink 31 is made of aluminum or other metallic material having a high degree of heat conductivity. However, the heatsink 31 may be made of other material such as a resin including heat-conductive metallic particles and a graphite sheet (i.e., a highly compatible graphite which is made by thermally decomposing or graphitizing a macromolecule film, and which has a structure close to a single crystal and features in its high degrees of heat conductivity and flexibility).

The heatsink 31 includes a horizontally extending plate portion 31*a* fixed to the bottom plate 24, and a vertically extending plate portion 31*b* fixed to the back plate 22. Below the horizontally extending plate portion 31*a* of the heatsink 31, there are disposed a pair of head units 40 and a cover plate 50.

Each of the head units 40 has a known construction, and includes a cavity unit 42 and a piezoelectric actuator 43 which is superposed on the cavity unit 42. The cavity unit 42 has a lower or outside surface in which a multiplicity of nozzle holes 41 are open. For example, as disclosed in JP-A-2001-246744 or its corresponding U.S. Pat. No. 6,604,817, the cavity unit 42 has a multiplicity of cavities held in communication with the respective nozzle holes 41. Upon application of a voltage between selected individual electrodes and common electrodes of the actuator 43, an ink within each of the cavities (corresponding to the selected individual electrodes) is pressurized whereby the ink is jetted as droplet from the corresponding nozzle hole 41 onto a recording medium.

A flexible circuit board is provided to extend from the actuator 43 of each head unit 40. The circuit board includes a flexible wiring board portion 44 having an end portion which is fixedly superposed on an upper surface of the actuator 43 of each head unit 40, as shown in FIG. 1. The circuit board further includes a driver element (driver circuit chip) 45 which is disposed on the flexible wiring board portion 44. This driver element 45 serves to drive the actuator 43. Described more specifically, the driver element 45 is adapted to transform drive waveform signals serially transmitted from a control circuit of the recording apparatus, into parallel signals applicable to the electrodes of the actuator 43. The driver element 45 then outputs the parallel signals at a predetermined value of voltage, into wires connected with the electrodes.

Figure 2:
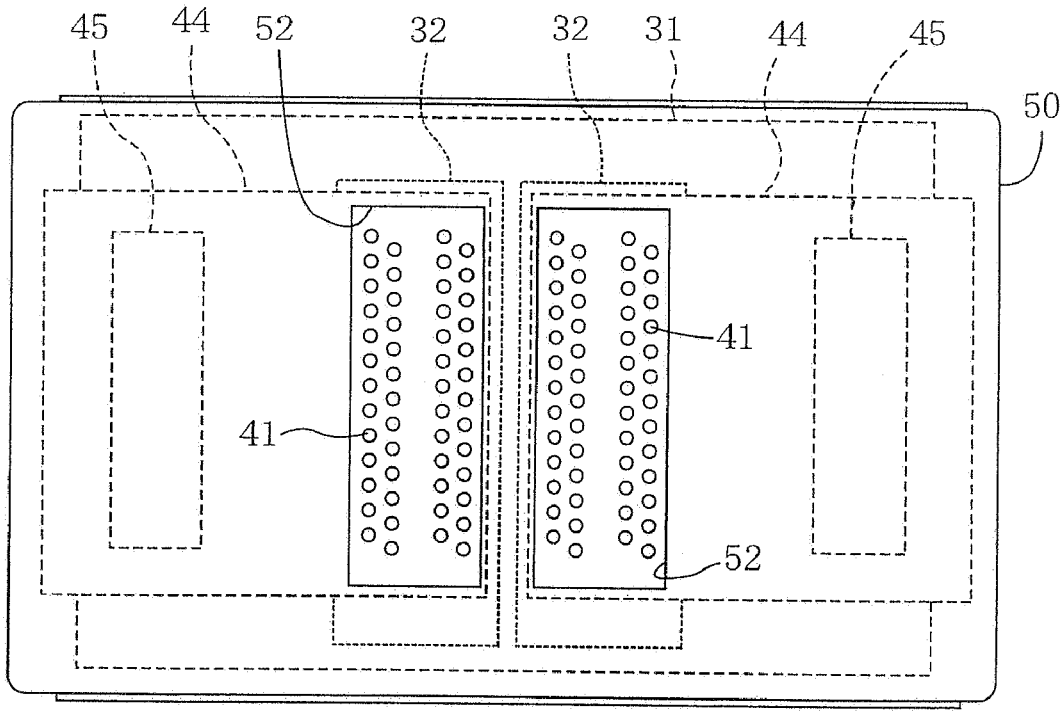
FIG. 2 is a bottom plan view of the recording head portion of FIG. 1.

The multiplicity of nozzle holes 41, which are open in the lower surface of the cavity unit 42 of each of the pair of head units 40, are arranged in four rows, as shown in FIG. 2. Two of the four rows of nozzle holes 41 are connected with one of the four ink cartridges 3, while the other two rows of nozzle holes 41 are connected with another one of the four ink cartridges 3. It is noted that the pair of head units 40 are disposed in parallel with each other so that eight rows of nozzle holes 41 are held in parallel with one another.

The heatsink 31 has, in its horizontally extending plate portion 31*a*, two void portions which are opposed to the respective two head units 40. The heatsink 31 has at least one void in each of the two void portions. In the present embodiment, this at least one void is provided by an aperture 32 formed through the horizontally extending plate portion 31*a*, as shown in FIG. 1. It is preferable that the aperture 32 has such a cross sectional area or size that permits the aperture 32 to overlap or intersect with almost an entirety of the actuator 43 of a corresponding one of the head units 40 as viewed in a plan view of the head unit 40, i.e., in a direction in which the void portion of the heatsink 31 and the corresponding head unit 40 are opposed to each other. However, the size of the aperture 32 may be increased to be larger than an area of the upper surface of the actuator 43 or cavity unit 42. The two head units 40 are positioned to be parallel with each other and to be opposed to the respective apertures 32, and are bonded or otherwise fixed to the horizontally extending plate portion 31*a* of the heatsink 31 while the flexible wiring board portion 44 is interposed therebetween. In the present embodiment, each of the head units 40 and the heatsink 31 are bonded to each other by adhesive which is applied into a gap between a periphery of the aperture 32 and an outer periphery of the head unit 40.

The body frame 21 has two cylindrical protrusions 24*a* which protrude downwardly from the bottom plate 24 and pass through the respective apertures 32 of the heatsink 31. Each of the two cylindrical protrusions 24*a* having the above-described ink supply passages 26 is held in contact with the upper surface of the cavity unit 42 of a corresponding one of the head units 40 which are fixed relative to the body frame 21, as shown in FIG. 3, whereby the ink supply passages 26 are held in communication with the respective cavities formed in the cavity unit 42, so that the ink can be supplied to the cavities through the ink supply passages 26.

While each of the head units 40 is fixed to the heatsink 31 as described above, the two flexible wiring board portions 44, which are fixed at their end portions to the respective head units 40, extend along the horizontally extending plate portion 31*a* of the heatsink 31 toward the opposite side plates 23 of the body frame 21, such that the driver elements 45 disposed on the respective wiring board portions 44 are positioned to be opposed to the lower surface of the horizontally extending plate portion 31*a* of the heatsink 31.

The wiring board portions 44 of the flexible circuit boards have respective distal end portions connected to respective relay boards 46 which are provided by rigid boards and which are fixed to outside surfaces of the respective side plates 23 of the body frame 21. The circuit boards 46 are connected to the above-described control circuit of the recording apparatus via flexible cables (not shown).

The cover plate 50 covers the head units 40 and parts of the respective wiring board portions 44 extending along the bottom plate 24, and is bonded or otherwise fixed to the body frame 21. The cover plate 50 is made of a metallic material such as stainless steel, and has a box-like structure consisting of a bottom wall and a circumferential wall that extends upwardly from a periphery of the bottom wall. A sealer 51 is interposed between the body frame 21 and an inner circumferential surface of the circumferential wall of the cover plate 50, as shown in FIGS. 1 and 3. The cover plate 50 has two openings 52 formed through its portions which are opposed to the respective head units 40, so that the nozzles 41 are exposed. A sealer (not shown) is interposed between a periphery of each opening 52 and the lower surface of the corresponding head unit 40, for thereby preventing electric systems of the piezoelectric actuators 43 and the wiring board portions 44 from being wetted by the ink.

Each of the driver elements 45 disposed on the respective wiring board portions 44 are forced, by an elastic body such as sponge (not shown) which are compressed to be interposed between the driver element 45 and an inner surface of the cover plate 50, against the lower or outside surface of the horizontally extending plate portion 31*a* of the heatsink 31, so that the driver element 45 is constantly and reliably held in thermally conductive communication with the heatsink 31. It is noted that the driver element 45 may be forced against the heatsink 31 by an insulated resin, in place of or in addition to the elastic body, which is provided between the cover plate 50 and the heatsink 31. In this arrangement, it is preferable that the insulated resin has a high degree of thermal conductivity so that the heat generated by the driver element 45 can be dissipated through the resin as well as through the heatsink 31.

In the recording head portion 2 constructed as described above, the heat generated by the driver elements 45 is transferred via the horizontally extending plate portion 31*a* of the heatsink 31 to the vertically extending plate portion 31*b* of the heatsink 31 which is parallel with the back plate 22 of the body frame 21 and which is exposed to the exterior of the recording head portion 2. The heat transferred to the vertically extending plate portion 31*b* is then dissipated or emitted to the exterior of the recording head portion 2, owing to an air flow caused on the outside surface of the vertically extending plate portion 31*b* as a result of movement of the carriage carrying the recording head portion 2. In this instance, the heat can be effectively dissipated, since the vertically extending plate portion 31*b* of the heatsink 31 extends in the horizontal direction (i.e., a direction of the carriage movement) over substantially an entire length of the back plate 22 and also in the vertical direction over substantially an entire height of the back plate 22, namely, since the vertically extending plate portion 31*b* has a large dissipating surface area. Further, in this instance, an open space is provided above each of the head units 40 owing to the apertures 32 formed through the heatsink 31, the heat generated by the driver elements 45 is unlikely to be transferred to each head unit 40 via the heatsink 31. Therefore, even if the heatsink 31 is heated to have a high temperature, considerable changes in actuation property of the piezoelectric actuator 43 and physical property of the ink are prevented. That is, it is possible to reliably perform a printing operation with a high quality, preventing deterioration in the quality of the printed image, which could be caused if the head unit 40 were thermally affected by the heatsink 31.

The size of the heatsink 31 can be determined suitably depending upon an expected amount of the heat generated by each driver element 45. For example, while the heatsink 31 is constituted by the horizontally and vertically extending plate portions 31*a*, 31*b* in the above-described embodiment, the heatsink 31 may consist of a flat plate where the expected heat amount is so small that the heat can be sufficiently dissipated by exposing the horizontally extending plate portion 31*a* to the exterior of the recording head portion 2. On the contrary, where it is necessary to further increase the dissipation capacity, fin-shaped ribs may be formed in the vertically extending plate portion 31*b* of the heatsink 31.

It is also possible to form through-holes in portions of the bottom plate 24 opposed to the apertures 32 of the heatsink 31, for increasing the open space above each head unit 40 so as to further reliably prevent each head unit 40 from being considerably heated. In this arrangement, it is preferable to provide a cover plate above each through-hole of the bottom plate 24 with a certain amount of spacing distance between the cover plate and the bottom plate 24, for preventing the ink from entering the head unit 40.

While the two apertures 32 are formed in the heatsink 31 in the above-described embodiment, the number of the aperture 32 may be one where the number of the head unit 40 is one rather than two.

Figure 4:
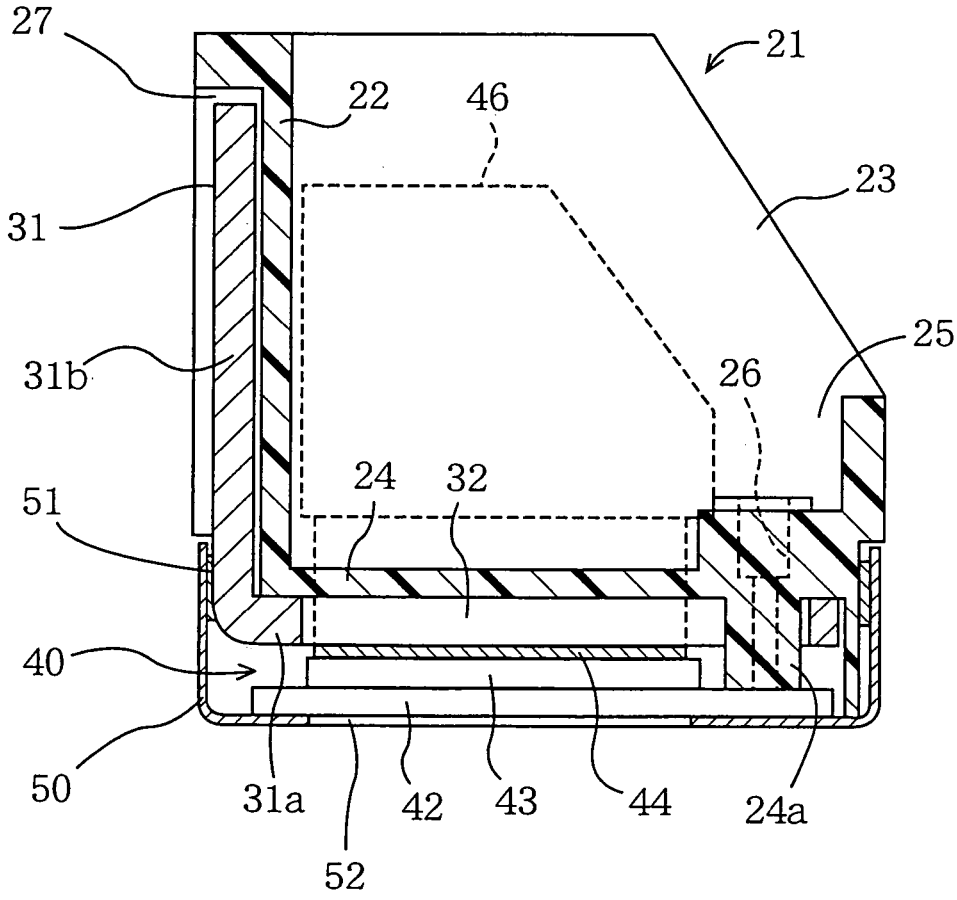
FIG. 4 is a side view in cross section of a modification of the recording head portion of FIG. 1.

While the heatsink 31 is provided to be held in contact with the bottom surface of the recess 27 of the body frame 21 in the above-described embodiment, the heatsink 31 may be positioned to be spaced apart from the body frame 21 by a small distance, for obtaining a dissipation air flow in the space therebetween during movement of the carriage. FIG. 4 shows such a modified arrangement in which the heatsink 31 is positioned relative to the body frame 21 such that a certain amount of space is formed between the back plate 22 of the body frame 21 and the vertically extending plate portion 31*b* of the heatsink 31.

Figure 5:
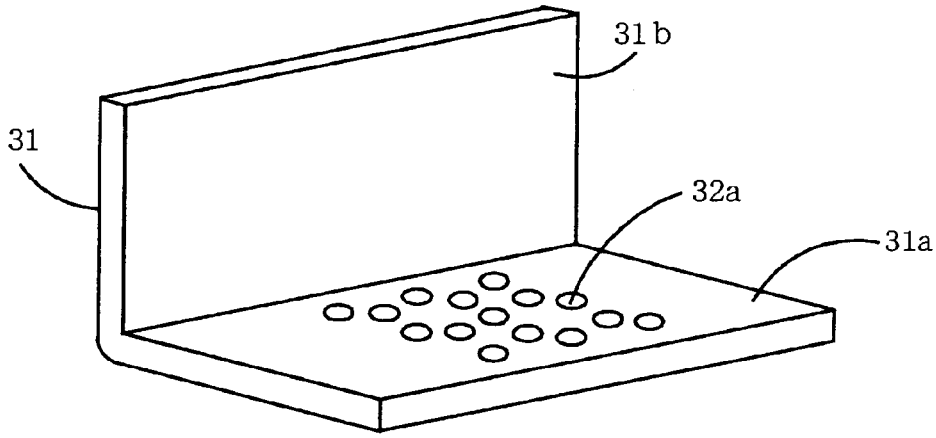
FIG. 5 is a perspective view of a modification of a heatsink provided in the recording apparatus of the embodiment of the invention.
Figure 6:
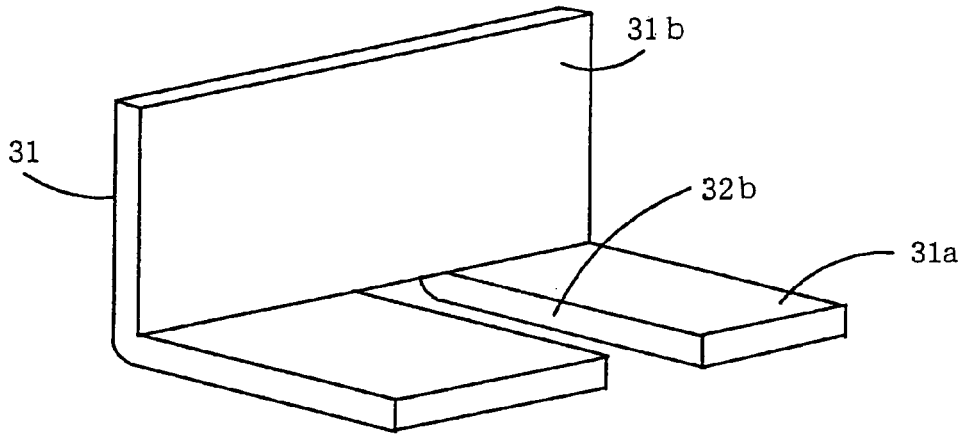
FIG. 6 is a perspective view of another modification of the heatsink.
Figure 7:
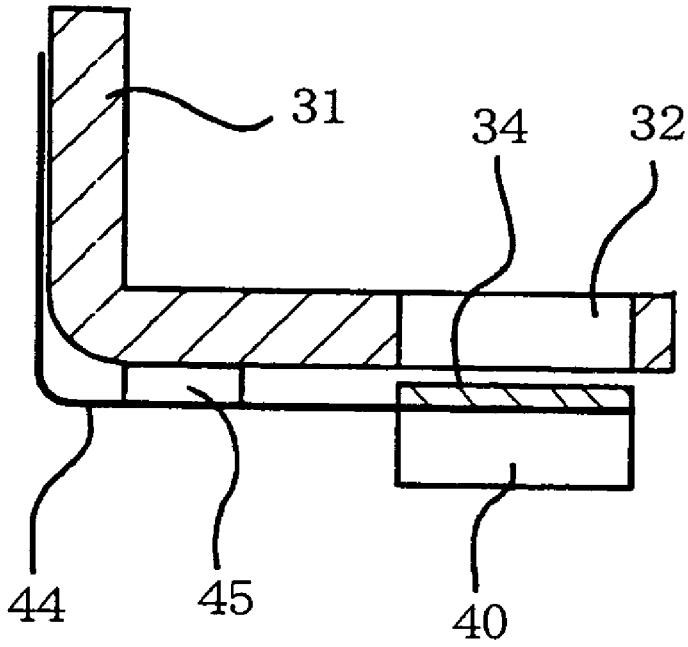
FIG. 7 is a side view in cross section of the heatsink and its vicinity in an arrangement in which a heat dissipation member is disposed in thermally conductive communication with a head unit.

While the aperture 32 is formed in the void portion of the heatsink 31 in the above-described embodiment, a plurality of apertures or through-holes 32*a* may be formed in the void portion of the heatsink 31, as shown in FIG. 5. Further, an elongated aperture or slot 32*b* may be formed in the void portion of the heatsink 31, as shown in FIG. 6, for example, such that the slot 32*b* is open at one edge of the horizontally extending plate portion 31*a* of the heatsink 31.

Where the actuator 43 of each head unit 40 is expected to generate a large amount of heat, a heat dissipation member 34 may be provided between each head unit 40 and the aperture 32 of the heatsink 31, as shown in FIG. 7, for absorbing the heat generated by the head unit 40 so as to dissipate the heat from the head unit 40. This heat dissipation member 34 is spaced apart from the heatsink 31 and positioned to be adjacent to the heat unit 40. More specifically described, the heat dissipation member 34 is superposed on the end portion of the wiring board portion 44 of the flexible circuit board, such that the heat dissipation member 34 is opposed to the head unit 40, with the end portion of the wiring board portion 44 being interposed therebetween. That is, the heat dissipation member 34, which is independent from the heatsink 31 having the apertures 32 formed therethrough, is disposed in thermally conductive communication with the head unit 40. The heat dissipation member 34 serves to remove the heat generated by the head unit 40 per se, for thereby preventing the head unit 40 from being considerably heated by the heat generated by itself. Further, since the heat dissipation member 34 is disposed without its contact with the heatsink 31, it is possible to prevent transfer of the heat from the heatsink 31 to the heat dissipation member 34.

While the preferred embodiment of the invention has been described in detail by reference to the accompanying drawings, it is to be understood that the invention is not limited to the details of the illustrated embodiment, but may be embodied with various other changes, modifications and improvements, which may occur to those skilled in the art.

What is claimed is:

1. A recording apparatus comprising:

a head unit including (i) a cavity unit which stores an ink in cavities formed therein, and (ii) an actuator which is operable to generate energy required for recording predetermined patterns of image on a recording medium so as to cause the ink to be ejected onto the recording medium;

a circuit board including a driver element which drives said actuator of said head unit;

a heatsink having a first surface and a second surface opposite to said first surface, and having at least one of said first and second surfaces disposed in thermally conductive communication with said driver element; and a body frame having a bottom plate portion to which said head unit is attached, said bottom plate portion being formed with an ink supply passage which communicates with said cavity unit, wherein said circuit board further includes a wiring board portion which extends along an outside surface of said bottom plate portion of said body frame from said head unit toward a periphery of said body frame, and on which said driver element is disposed, wherein said the heatsink includes a horizontally extending plate portion which provides said first and second surfaces and which extends along said bottom plate portion of said body frame, and wherein said heat sink has a void portion on at least one of said first and second surfaces, said void portion being opposed to said head unit.

2. The recording apparatus according to claim 1, wherein said head unit further includes a cavity unit which stores an ink in cavities formed therein, and wherein said actuator is a piezoelectric actuator which is superposed on said cavity unit and which is operable to eject the ink onto the recording medium.

3. The recording apparatus according to claim 2, wherein said cavity unit of said head unit has a surface which is to be opposed to the recording medium, and a plurality of nozzle holes which are held in communication with the respective cavities of said cavity unit and which are open in said surface.

4. The recording apparatus according to claim 2, further comprising a body frame which accommodates an ink supply source and which includes a bottom plate portion having ink supply passages formed therethrough so that the ink is supplied from said ink supply source to said cavities of said cavity unit of said head unit through said ink supply passages, wherein said body frame further includes a back plate portion extending vertically from said bottom plate portion, wherein said heatsink includes a horizontally extending plate portion which has said void portion and which extends along an outside surface of said bottom plate portion of said body frame, wherein said circuit board including said driver element extends along said horizontally extending plate portion of said heatsink, and wherein said heatsink further includes a vertically extending plate portion which extends along an outside surface of said back plate portion of said body frame.

5. The recording apparatus according to claim 1, wherein said void portion of said heatsink includes an aperture formed through said heatsink between said first surface and said second surface such that said aperture overlaps at least a portion of said head unit as viewed in a direction in which said void portion of said heatsink and said head unit are opposed to each other.

6. The recording apparatus according to claim 5, wherein said aperture is open at one edge of said heatsink.

7. The recording apparatus according to claim 1, wherein said void portion of said heatsink includes a plurality of holes formed through said heatsink between said first surface and said second surface.

8. The recording apparatus according to claim 1, further comprising a heat dissipation member disposed in thermally conductive communication with said head unit and spaced apart from said heatsink, so as to dissipate heat from said head unit.

9. The recording apparatus according to claim 8, wherein said circuit board further includes a wiring board portion which has an end portion superposed on said one head unit, and wherein heat dissipation member is superposed on said end portion of said wiring board portion of said circuit board, such that said heat dissipation member is opposed to said head unit, with said end portion of said wiring board portion being interposed between said heat dissipation member and said head unit.

10. The recording apparatus according to claim 1, wherein said circuit board is disposed between said heatsink and said head unit.

11. The recording apparatus according to claim 1, wherein:

one of said first and second surfaces of said heatsink is disposed in thermally conductive communication with said driver element; and said void portion has an opening that opens in said one of said first and second surfaces.

12. The recording apparatus according to claim 1, wherein:

said heatsink includes a plate portion; and said heatsink has an aperture which is opposed to said head unit and which is formed through a thickness of said plate portion.

13. The recording apparatus according to claim 12, wherein said circuit board is disposed between said heatsink and said head unit, and is held in contact at opposite surfaces thereof with said head unit and said plate portion of said heat sink.

14. The recording apparatus according to claim 1, wherein said void portion of said heatsink includes an aperture formed through said heatsink between said first surface and said second surface such that said aperture overlaps substantially an entirety of said head unit as viewed in a direction in which said aperture of said heatsink and said head unit are opposed to each other.

15. A recording apparatus comprising:

a head unit including (i) a cavity unit which stores an ink in cavities formed therein, and (ii) a piezoelectric actuator which is superposed on said cavity unit and which is operable to generate energy required for recording predetermined patterns of image on a recording medium so as to eject the ink onto the recording medium;

a circuit board including a driver element which drives said actuator of said head unit;

a heatsink disposed in thermally conductive communication with said driver element and having a void portion that is opposed to said head unit;

a body frame which accommodates an ink supply source and which includes a bottom plate portion having ink supply passages formed therethrough so that the ink is supplied from said ink supply source to said cavities of said cavity unit of said head unit through said ink supply passages, wherein said circuit board further includes a wiring board portion which extends along an outside surface of said bottom plate portion of said body frame from said head unit toward a periphery of said body frame, and wherein said heatsink includes a horizontally extending plate portion which has said void portion and which is interposed between said bottom plate portion of said body frame and said wiring board portion of said circuit board.

16. The recording apparatus according to claim 15, further comprising a cover plate which covers said outside surface of said bottom plate portion of said body frame, wherein said horizontally extending plate portion of said heat sink is located between said bottom plate portion of said body frame and said cover plate.

17. A recording apparatus comprising:

a head unit including (i) a cavity unit which stores an ink in cavities formed therein, and (ii) a piezoelectric actuator which is superposed on said cavity unit and which is operable to generate energy required for recording predetermined patterns of image on a recording medium so as to eject the ink onto the recording medium;

a circuit board including a driver element which drives said actuator of said head unit;

a heatsink disposed in thermally conductive communication with said driver element and having a void portion that is opposed to said head unit;

a body frame which accommodates an ink supply source and which includes a bottom plate portion having ink supply passages formed therethrough so that the ink is supplied from said ink supply source to said cavities of said cavity unit of said head unit through said ink supply passages, wherein said circuit board further includes a wiring board portion which extends along an outside surface of said bottom plate portion of said body frame from said one head unit toward a periphery of said body frame, wherein said driver element is disposed on said wiring board portion, and wherein said heatsink includes a horizontally extending plate portion which has said void portion and which is disposed on one of opposite sides of said wiring board portion remote from said driver element.

18. A recording apparatus comprising:

a plurality of head units each including (i) a cavity unit which stores an ink in cavities formed therein, and (ii) an actuator which is operable to generate energy required for recording predetermined patterns of image on a recording medium so as to cause the ink to be ejected onto the recording medium;

a plurality of circuit boards each including a driver element which drives said actuator of a corresponding one of said head units;

a heatsink having a first surface and a second surface opposite to said first surface, and having at least one of said first and second surfaces disposed in thermally conductive communication with said respective driver elements; and a body frame having a bottom plate portion to which said head units are attached, said bottom plate portion being formed with ink supply passages which communicate with said cavity units, wherein each of said circuit boards further includes a wiring board portion which extends along an outside surfaces of said bottom plate portion of said body from a corresponding one of said head units toward a periphery of said body frame, and on which said driver element is disposed, wherein said heatsink includes a horizontally extending plate portion which provides said first and second surfaces and which extends along said bottom plate portion of said body frame, and wherein said heatsink has a plurality of void portions on at least one of said first and second surfaces, said void portions being opposed to the respective head units.

19. The recording apparatus according to claim 18, wherein each of said void portions of said heatsink includes an aperture formed through said heatsink such that said aperture overlaps at least a portion of a corresponding one of said head units as viewed in a direction in which said void portions of said heatsink and said head units are opposed to each other.

20. A recording apparatus comprising:

a head unit including a cavity unit which stores an ink, and an actuator which is operable to eject the ink onto a recording medium and which is superposed on said cavity unit;

a body frame to which said head unit is attached, said body frame having a bottom plate portion formed with an ink supply passage which communicates with said cavity unit;

a circuit board overlying said actuator and including a driver element which drives said actuator; and a heatsink including a horizontally extending plate portion and a vertically extending plate portion, and disposed in thermally conductive communication with said driver element, said horizontally extending plate portion extending along said bottom plate portion of said body frame and having an aperture opposed to said head unit, and said vertically extending plate portion extending vertically from said horizontally extending plate portion.

* * * * *